US005639020A

United States Patent [19]

Yau

[11] Patent Number: 5,639,020

[45] Date of Patent: Jun. 17, 1997

[54] HORSEWHIP COUPLING CONFIGURATION

[76] Inventor: Yeong-Jyi Yau, 157, Ben Tou Road, Shen Kang Hsiang, Chang Hua County, Taiwan

[21] Appl. No.: 439,174

[22] Filed: May 11, 1995

[51] Int. Cl.[6] ..... B68B 11/00

[52] U.S. Cl. ..... 231/2.1

[58] Field of Search ..... 231/2.1, 4, 5, 6

[56] References Cited

U.S. PATENT DOCUMENTS 361,763 4/1887 Herrick ..... 231/6 X
509,452 11/1893 Sanders ..... 231/5

FOREIGN PATENT DOCUMENTS 133788 7/1947 Australia ..... 231/4

*Primary Examiner*—Robert P. Swiatek
*Attorney, Agent, or Firm*—Charles E. Baxley, Esq.

[57] ABSTRACT

A horsewhip includes a coupler having one end secured to a handle portion and having a ring formed in the other end. The coupler includes a recess formed in the middle portion. A tail portion includes a loop formed in one end for engaging with the recess of the coupler and includes a free end for engaging through the opening of the ring so as to solidly secure the tail portion to the handle portion. The tail portion may be easily secured to and may be easily disengaged from the handle portion by the users such that the tail portion can be easily replaced with a brand new one.

1 Claim, 3 Drawing Sheets

HORSEWHIP COUPLING CONFIGURATION

BACKGROUND OF THE INVENTION

1. Field of the Invention

The present invention relates to a horsewhip, and more particularly to a coupling configuration of the tail portion to the handle portion of the horsewhip.

2. Description of the Prior Art

Typical horsewhips comprise a handle portion and a tail portion solidly secured to the handle portion. However, the tail portion can not be easily secured to and disengaged from the handle portion such that the tail portion may not be easily replaced with a brand new one when the tail portion is broken. It is inconvenient for the users to secure a tail portion to the handle portion and to disengage the tail portion from the handle portion. In addition, the tail portion may be easily disengaged from the handle portion during using such that the tail portion may be easily lost.

The present invention has arisen to mitigate and/or obviate the afore-described disadvantages of the conventional horsewhips.

SUMMARY OF THE INVENTION

The primary objective of the present invention is to provide a horsewhip which includes a tail portion that may be easily secured to and disengaged from the handle portion by the users such that the tail portion can be easily replaced with a brand new one.

In accordance with one aspect of the invention, there is provided a horsewhip comprising a handle portion including a first end, a coupler including a first end secured to the first end of the handle portion and including a second end having a ring provided therein, the ring including an opening formed therein, and the coupler including a middle portion, and a tail portion including a first end having a loop formed thereon for engaging with the coupler and including a second end for engaging through the opening of the ring so as to solidly secure the tail portion to the handle portion.

The coupler includes a recess formed in the middle portion for engaging with the loop so as to solidly secure the tail portion to the coupler. The ring is arranged inclined relative to the coupler so as to maintain the tail portion in a straight configuration. The coupler is preferably made of rubber materials.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
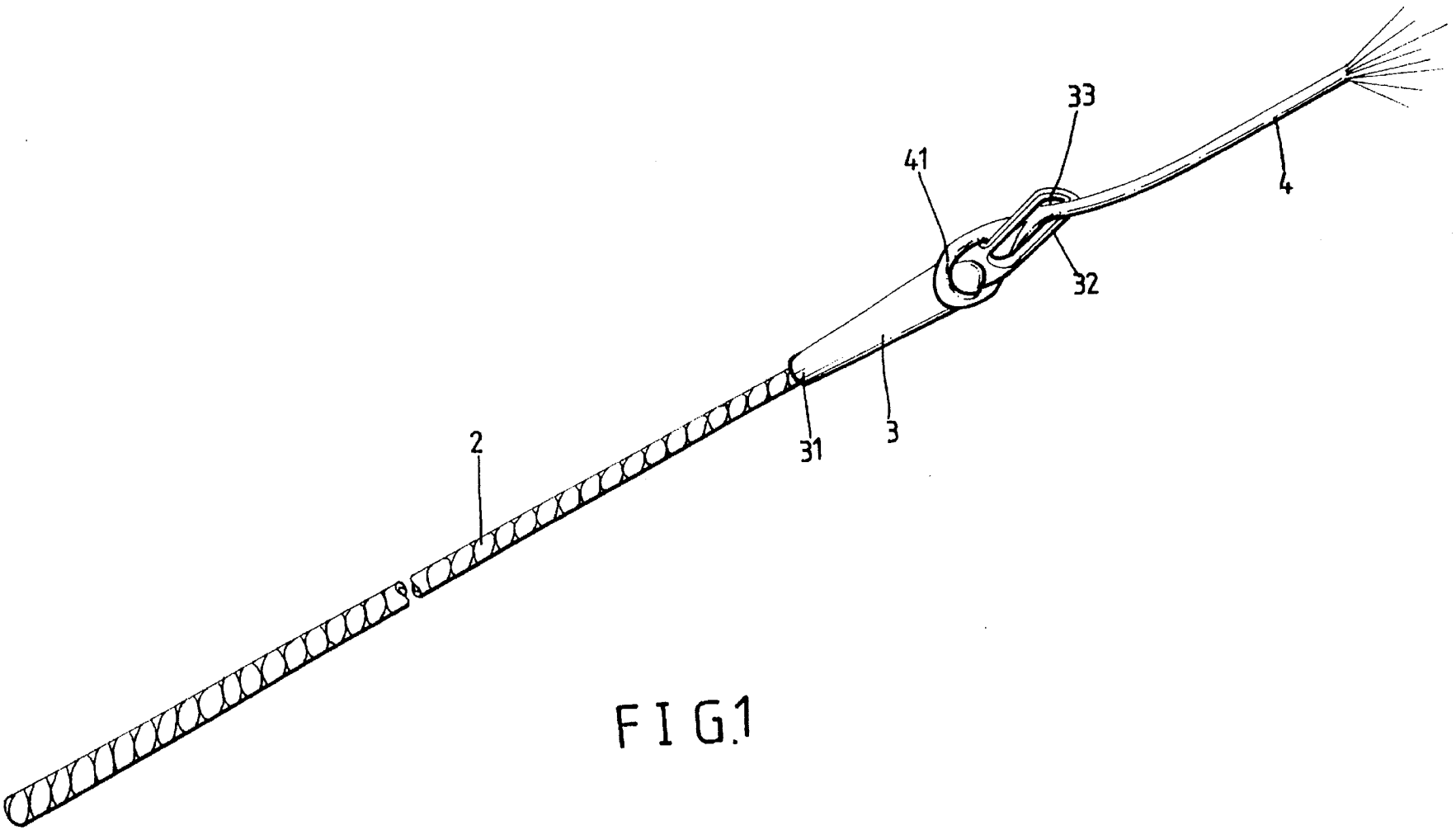
FIG. 1 is a perspective view of a horsewhip in accordance with the present invention.
Figure 2:
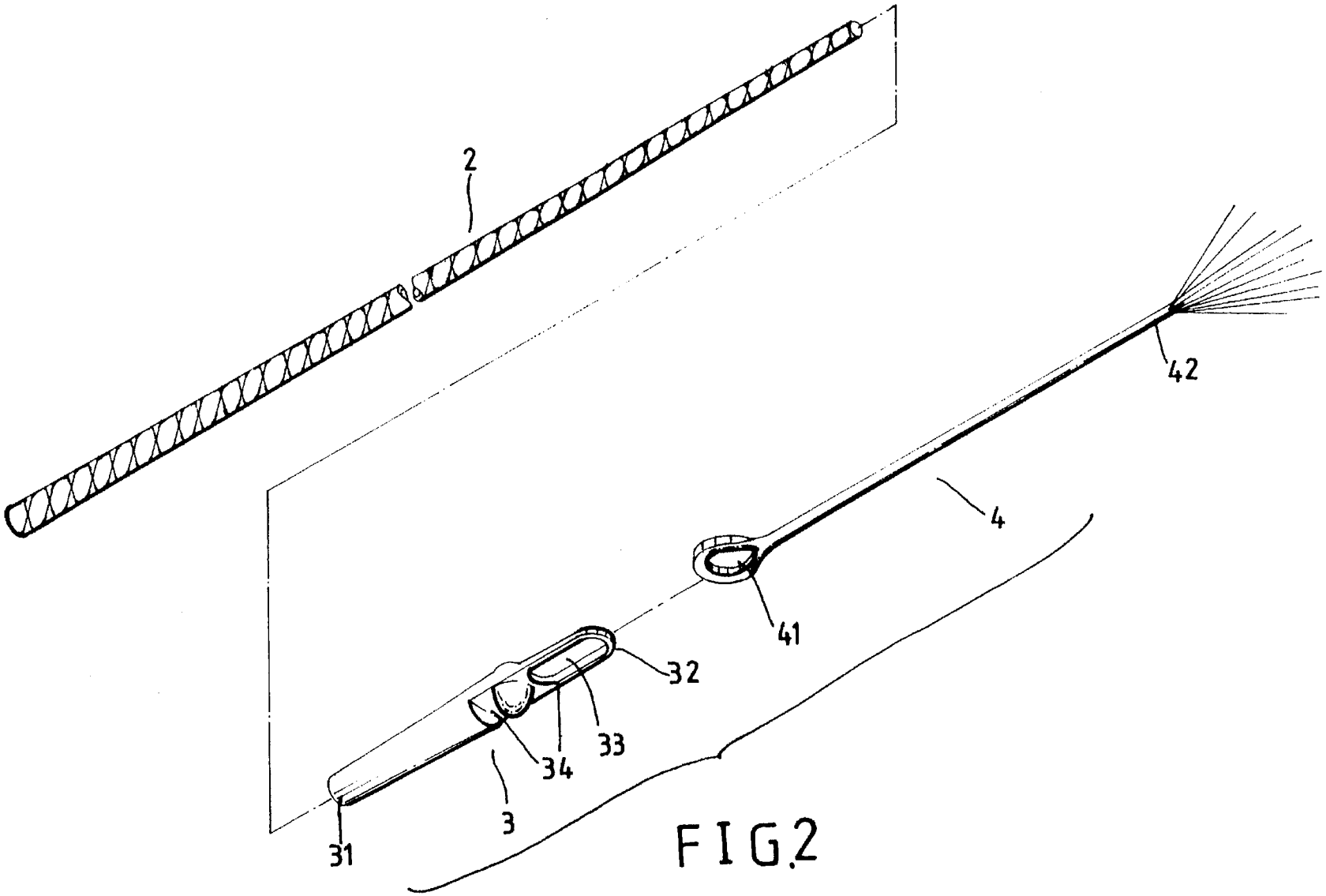
FIG. 2 is an exploded view of the horsewhip.

Referring to the drawings, a horsewhip in accordance with the present invention comprises a handle portion 2 and a tail portion 4 for securing to the handle portion 2. A coupler 3 includes one end 31 solidly secured to the handle portion 2 and includes a ring 32 formed in the other end and having an opening 33 formed therein. The coupler 3 further includes a recess 34 formed in the center portion thereof. It is preferable that the coupler 3 is made of rubber materials so as to include suitable resilience and softness.

Figure 3:
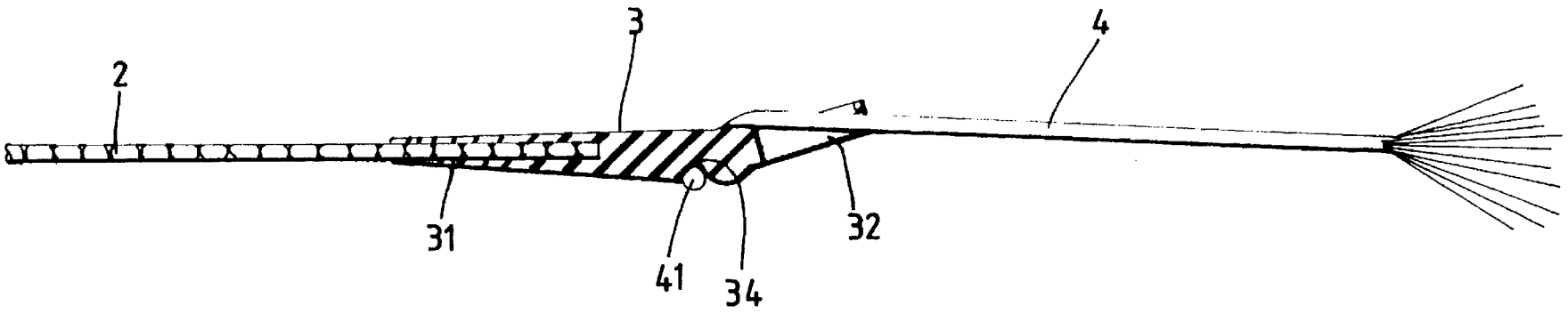
FIG. 3 is a cross sectional view of the coupling portion of the tail portion to the handle portion.

The tail portion 4 includes a loop 41 formed in one end for engaging with the coupler 3 and includes the other end portion 42 engaged through the opening 33 of the ring 32 such that the tail portion 4 can be solidly secured to the handle portion 2 and such that the tail portion 4 can be easily disengaged from the handle portion 2 by the users by engaging the other end 42 of the tail portion 4 back through the opening 33 of the ring 32. The loop 41 may be engaged with the recess 34 such that the tail portion 4 may further be solidly secured to the handle portion 2. As best shown in FIG. 3, the ring 32 is preferably arranged inclined relative to the coupler 3 such that the tail portion 4 may be suitably maintained in a configuration as straight as possible.

Accordingly, the horsewhip in accordance with the present invention includes a tail portion that may be easily secured to and may be easily disengaged from the handle portion by the users such that the tail portion can be easily replaced with a brand new one.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A horsewhip comprising:

a handle portion including a first end, a coupler including a first end secured to said first end of said handle portion and including a second end having a ring provided therein, said ring including an opening formed therein, and said coupler being made of rubber material and including a middle portion having a recess formed therein, and a tail portion including a first end having a loop formed thereon for engaging with said coupler and including a second end for engaging through said opening of said ring and for solidly securing said tail portion to said handle portion, said loop of said tail portion being engaged with said recess of said coupler for solidly securing said tail portion to said coupler, said ring being arranged inclinedly relative to said coupler for maintaining said tail portion in a straight configuration, and said coupler being made of rubber material for allowing said coupler and said tail portion to be sent.

* * * * *